United States Patent [19]

McLoughlin et al.

[11] 4,324,294

[45] Apr. 13, 1982

[54] CHEMICAL INJECTION CONTROL SYSTEM FOR FIRE FIGHTING

[75] Inventors: John McLoughlin, 92 Mobrey La., Smithtown, N.Y. 11787; Neocles Athanasiades, Setauket; Yehuda Rotblum, Lake Grove, both of N.Y.

[73] Assignee: John McLoughlin, Smithtown, N.Y.

[21] Appl. No.: 141,777

[22] Filed: Apr. 21, 1980

Related U.S. Application Data

[63] Continuation-in-part of Ser. No. 10,180, Feb. 7, 1979, Pat. No. 4,246,969.

[51] Int. Cl.[3] ..... A62C 35/16

[52] U.S. Cl. ..... 169/13; 137/88; 137/101.21; 222/55; 222/63; 222/133; 239/61; 239/127

[58] Field of Search ..... 169/13, 14, 15, 27; 239/61, 62, 124, 127, 310; 137/3, 10, 88, 101.21; 222/55, 57, 63, 71, 133, 134, 135, 145, 318

[56] References Cited

U.S. PATENT DOCUMENTS

| | | | |
|---|---|---|---|
| 2,349,521 | 5/1944 | Schmidt | 137/88 X |
| 2,872,072 | 2/1959 | Reed | 222/145 X |
| 3,038,486 | 6/1962 | Thurman | 137/101.21 X |
| 3,115,158 | 12/1963 | Sheppard | 169/14 X |
| 3,123,252 | 3/1964 | Kuntz | 222/57 X |
| 3,298,383 | 1/1967 | Cooper | 137/88 X |
| 3,520,448 | 7/1970 | Russell | 222/57 |
| 3,642,171 | 2/1972 | Ernst | 222/57 X |
| 3,900,043 | 8/1975 | Bowen et al. | 137/101.21 |
| 4,007,755 | 2/1977 | Lerner et al. | 137/101.21 |

*Primary Examiner*—Gil Weidenfeld
*Assistant Examiner*—Fred A. Silverberg
*Attorney, Agent, or Firm*—James P. Malone

[57] ABSTRACT

A system for injecting chemicals into a fire fighting system of the type using a plurality of water hoses and having a source of water and a source of chemicals. A servo motor system is connected to automatically meter a certain ratio of chemicals into the water supply. The servo motor system is responsive to the total flow to control the chemical pump to pump a certain ratio of chemicals into the water supply even if the total flow varies. Various modifications are disclosed.

1 Claim, 9 Drawing Figures

CHEMICAL INJECTION CONTROL SYSTEM FOR FIRE FIGHTING

This application is a Continuation-in-part of Ser. No. 010,180, filed Feb. 7, 1979, of the same title, now U.S. Pat. No. 4,246,969, granted on Jan. 27, 1981.

BACKGROUND ART

This invention relates to chemical injection means for fire fighting and more particularly to an automatic electrically controlled system for providing a desired ratio of chemicals to total flow.

Foam or other type chemicals are frequently added to the water used in fighting fires. A desired ratio of chemcials to total flow is desirable but this is difficult to achieve and maintain since the total flow is liable to change quite often, for instance, due to change in the supply pressure or due to the adding or subtracting of hoses from the water supply.

Conventional chemical injection apparatus generally uses manually operated mechanical mixing apparatus.

DISCLOSURE OF INVENTION

The present invention provides means to automatically meter a certain ratio of chemicals into the water supply and this ratio is maintained electrically.

In one embodiment, a servo motor responsive to the total flow controls the pump for the chemical.

In another embodiment a valve is automatically controlled to control the chemical.

The present injection system is designed to inject any type of fire fighting chemical such as rapid water, wet water or penetrating agents and increases the capability of a fire fighting system. Using a Flow Monitoring System, it is possible to measure the total flow out of a vehicle. When the total flow is known, it is a matter of operating an electric driven positive displacement pump at the correct speed to give an accurate mixing ratio. The present inexpensive system is designed to give years of service to any fire truck that it is installed on.

Accordingly, a principal object of the invention is to provide new and improved means to inject chemicals into water in fire fighting systems.

Another object of the invention is to provide new and improved means to inject chemicals into water in fire fighting systems including means to maintain a desired ratio between chemical and total flow.

Another object of the invention is to provide new and improved means to inject chemicals into a fire fighting system of the type using a plurality of water hoses comprising, a source of water supply, a source of chemicals, and means to automatically meter a certain ratio of chemicals into the water supply.

BRIEF DESCRIPTION OF DRAWINGS

These and other objects of the invention will be apparent from the following specification and drawings of which.

BEST MODE FOR CARRYING OUT THE INVENTION

Figure 1:
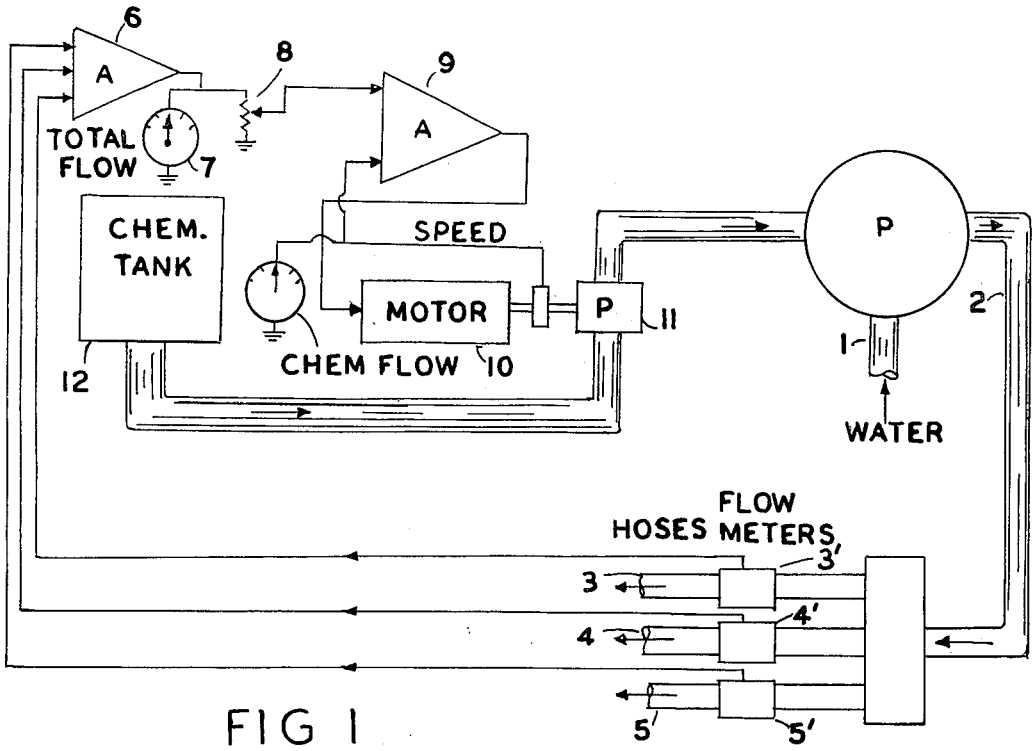
FIG. 1 is a schematic diagram of the embodiment of the invention.

Referring to FIG. 1, water is supplied from a hose through the pipe 1, to the pump P and the output 2. The pump P is connected to the hoses 3, 4, 5 and flow meters 3', 4', 5', are connected to each hose. The outputs of the flow meters are connected to the input of amplifier 6 which provides an indication of total flow which may be read on the meter 7. A signal proportional to total flow is connected to potentiometer 8, the output of which is connected to the amplifier 9. The function of potentiometer 8 is to set in a desired ratio between chemicals and total flow. The output of amplifier 9 is connected to an electric motor 10 which operates a pump 11, which pumps foam or chemical flow from the tank 12 to the water pump P.

By setting in the desired ratio on the potentiometer 8 the desired ratio will be maintained by the amplifier 9 controlling the speed of the electric motor 10, which in turn controls the chemical pump 11.

Figure 2:
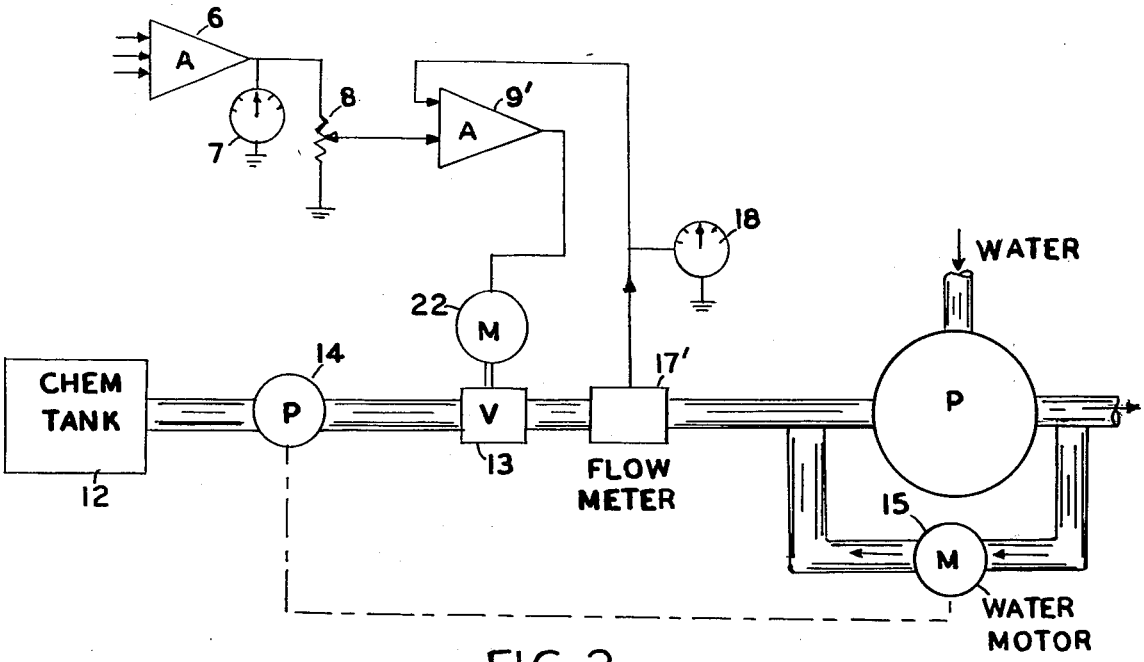
FIGS. 2 and 3 are schematic diagrams of modifications of the invention.

FIG. 2 illustrates a modification of the invention which is similar to the embodiment of FIG. 1 except that instead of controlling an electric motor and pump the servo amplifier 9' controls a motor 22 which controls valve 13 and it is valve 13 which controls the ratio of chemical to total flow. In this embodiment the chemical pump 14 is driven by a water driven motor 15 which is driven by water flow in the system.

In FIG. 2 the ratio is set into the potentiometer 8 and the amplifier 9' is responsive to the ratio from potentiometer 8 and the chemical flow from the flow meter 17'. The gauge 18 reads the chemical flow.

Figure 3:
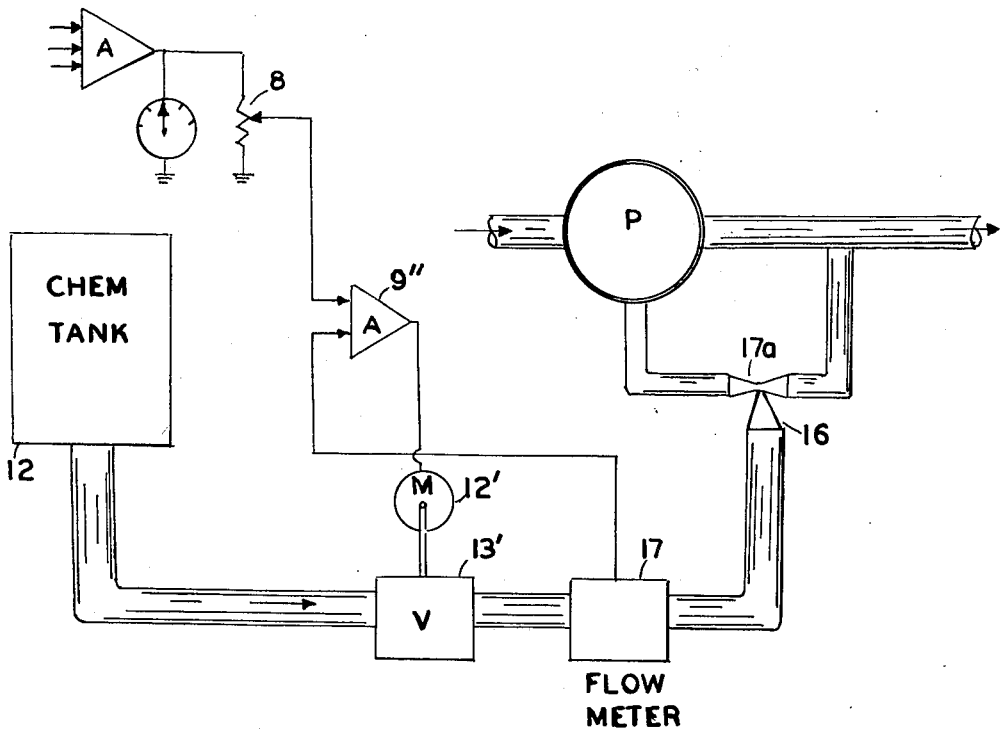

FIG. 3 illustrates another embodiment of the invention which is similar to the embodiment of FIGS. 1 and 2. In this embodiment, the amplifier 9'' drives a servo motor 12' which controls the chemical valve 13'. In this embodiment the chemical is sucked out of the tank because of the connection of the chemical pipe 16 to a Venturi connection **17*a* in the water supply. Therefore no chemical pump is necessary. The servo motor part of the system is similar to FIG. 2. The ratio is set in on the potentiometer 8 and amplifier 9'' is responsive to the ratio of total flow and the chemical flow from the flow meter 17**.

Figure 4:
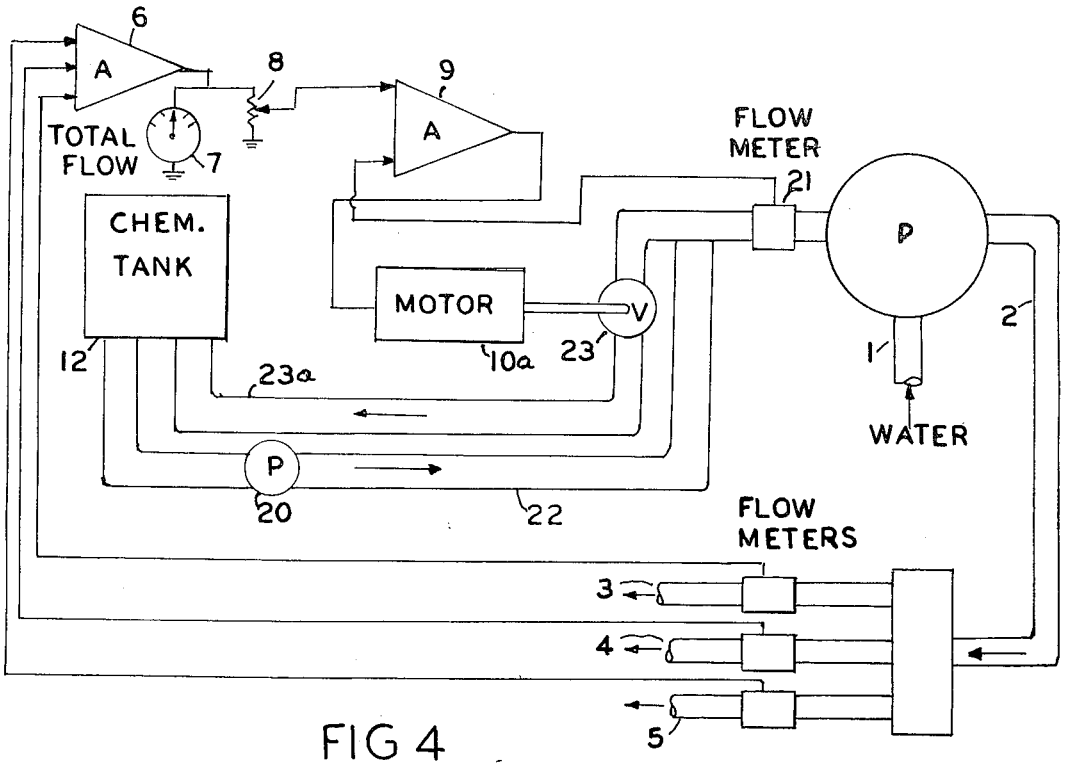
FIGS. 4 to 9 show schematic diagrams of modifications of the invention.

FIG. 4 shows a system similar to FIG. 1, wherein the amplifier 9 is controlled by the flow meter 21. The main line 22 has a manually operated pump 20. In situations where there is an excess of chemical the flow meter 21, via amplifier **9*a*, and the motor 10*a*, controls the valve 23 to return the excess amount to the chemical tank 12, via line 23*a***. This system is used in installations such as ships where it is common practice to pump excess amounts for speedy results.

Figure 5:
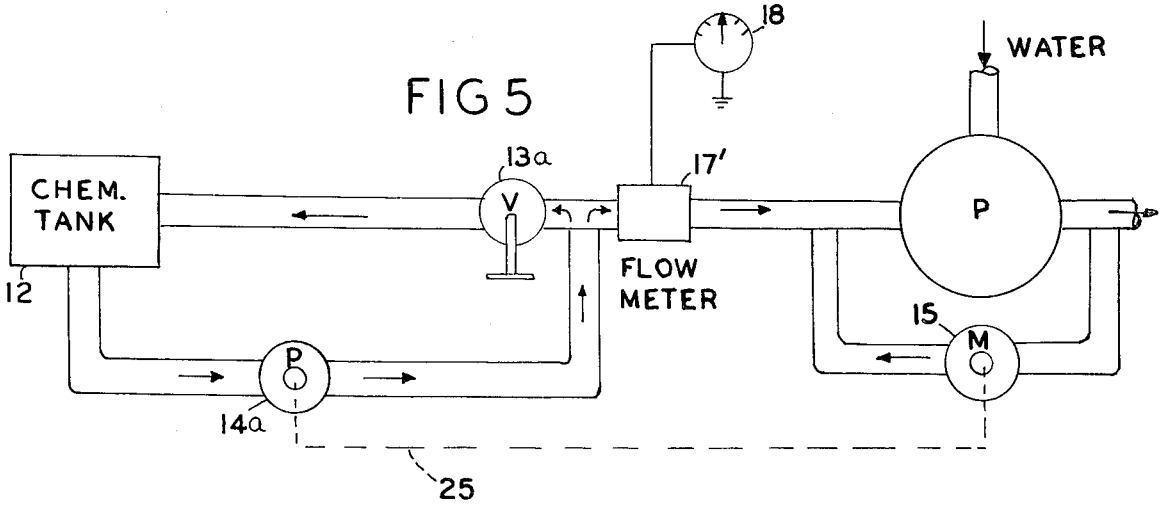

FIG. 5 shows a system similar to that of FIG. 2, wherein the pump **14*a* is located in the bypass line 25, so that any excess of the chemical discharge is valved by the valve 13*a* and returned to the chemical tank 12**.

Figure 6:
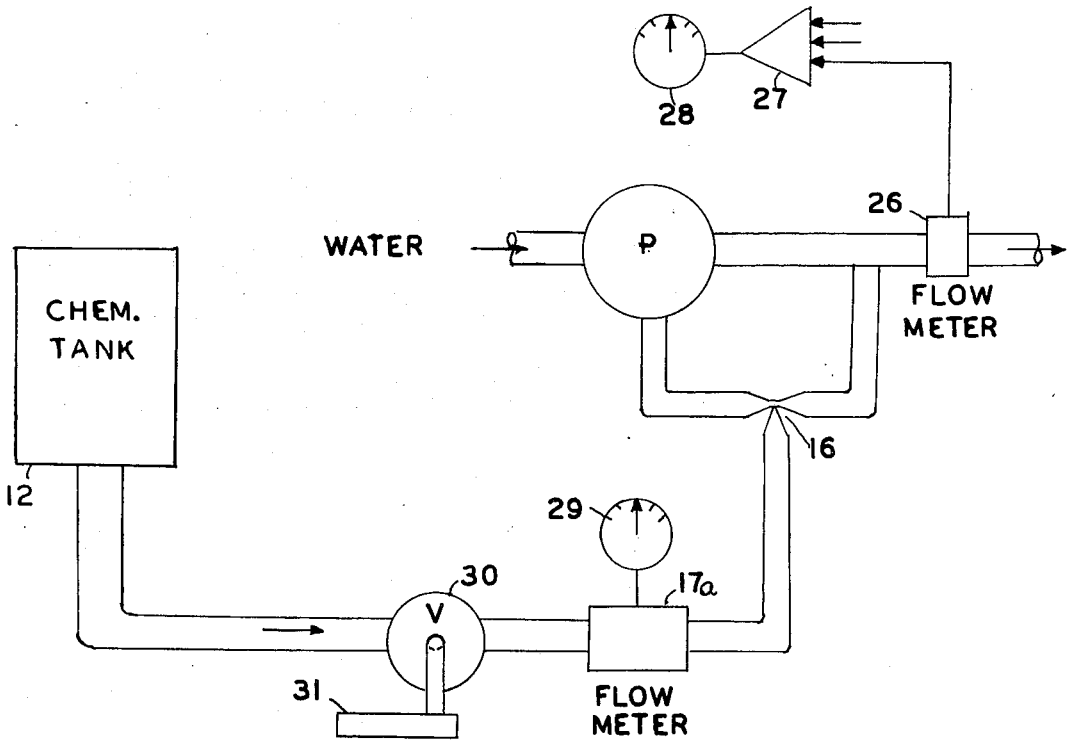

FIG. 6 shows a manual system which is somewhat similar to that of FIG. 3. The total flow is read by flow meter 26, the output of which is fed to amplifier 27 and indicated on meter 28. The chemical flow is measured by the flow meter **17*a* and indicated on the meter 29. The operator monitors the meters and operates the manual valve 30 by means of the handle 31**.

Figure 7:
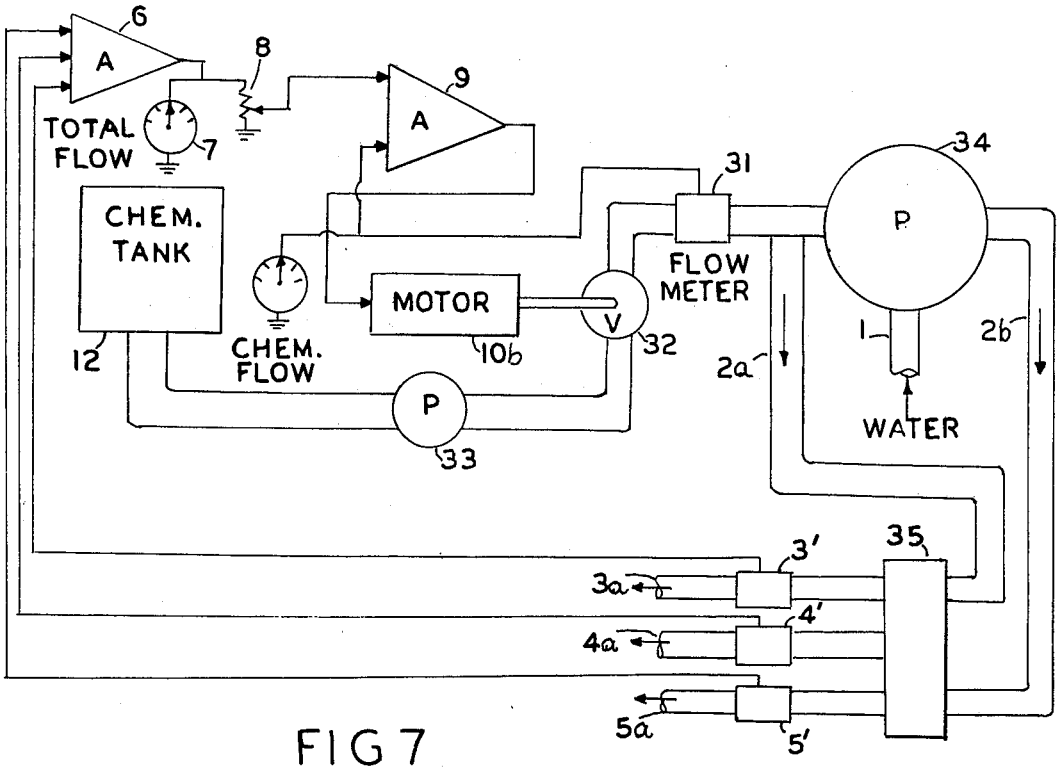

FIG. 7 shows another system somewhat similar to that of FIG. 1 wherein the chemical flow is measured by the flow meter 31, which controls the speed of the motor 10*b*, which operates a valve 32. The valve 32 controls the output of chemical pump 33. The chemicals may be injected into the manifold 35 either through line 2*a* before the water pump 34 and/or line 2*b* after the water pump 34. The manifold 35 feeds the hose line 3*a*, 4*a*, 5*a*.

Figure 8:
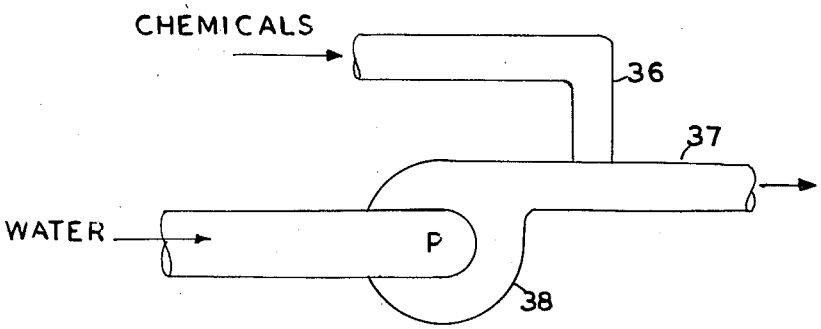

FIG. 8 shows a modification which is applicable to the previous systems wherein the chemical is injected in line 36 into the discharge line 37 of the water pump 38.

Figure 9:
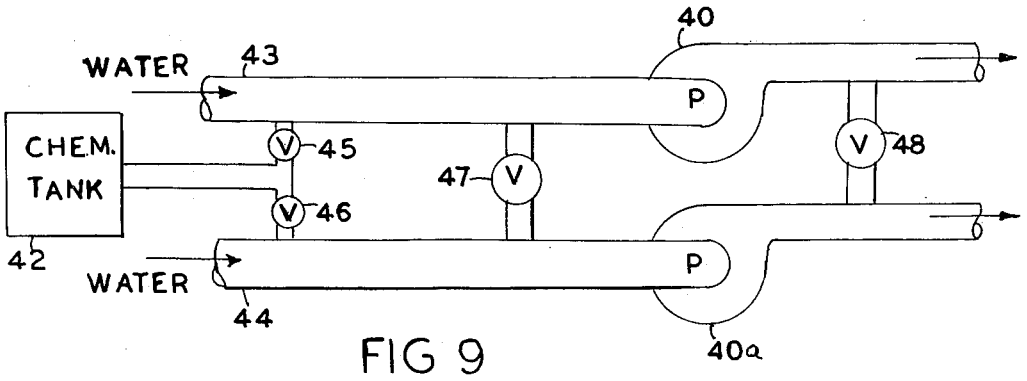

FIG. 9 shows a system which may be used in the case of a pump having two rotors with separate intake and discharge systems. In this case, the double pump 40, 40*a*, has two discharges 41, 41*a*. The chemical is fed from the chemical tank 42 into water lines 43, 44, by means of the valves 45, 46. Valve 47 is connected across the inputs to the pumps 40, 40*a* for controlling relative inputs. Valve 48 is connected across the output lines 41, 41*a* for controlling the output ratios. With this system we can inject on either of the two intakes by means of the valves 45, 46 allowing foam to be selected in discharge lines 41, 41*a*, if valves 47, 48 are closed, thereby providing flexibility of operation.

It is claimed:

1. Means to inject chemicals into a fire fighting system of the type having a plurality of water hoses, a source of water supply, and a source of chemicals;

means to automatically meter a certain ratio of chemicals into the water supply comprising:

a first line connecting the chemical source to the water supply, means to measure the total flow, a manual chemical pump connected to the chemical source in the first line and connected to pump chemicals into the water supply, a second line connected in parallel with the first line, a valve connected completely within the second line, and servo motor means responsive to the total flow to control the valve to pump any excess of chemicals back to the chemical source, means in the first line upstream of the source of water supply to allow a portion of the chemicals to be dispensed while the valve is opened and the excess chemicals are being returned to the chemical source.

* * * * *